US010486386B2

(12) United States Patent
Kimura

(10) Patent No.: US 10,486,386 B2
(45) Date of Patent: Nov. 26, 2019

(54) SLIDE LOCK DEVICE FOR PRESS MACHINE

(71) Applicant: PASCAL ENGINEERING CORPORATION, Itami-shi, Hyogo (JP)

(72) Inventor: Seiji Kimura, Itami (JP)

(73) Assignee: Pascal Engineering Corporation, Hyogo (JP)

( * ) Notice: Subject to any disclaimer, the term of this patent is extended or adjusted under 35 U.S.C. 154(b) by 228 days.

(21) Appl. No.: 15/528,788

(22) PCT Filed: Dec. 2, 2014

(86) PCT No.: PCT/JP2014/081830
§ 371 (c)(1),
(2) Date: May 23, 2017

(87) PCT Pub. No.: WO2016/088194
PCT Pub. Date: Jun. 9, 2016

(65) Prior Publication Data
US 2017/0313014 A1 Nov. 2, 2017

(51) Int. Cl.
*B30B 15/28* (2006.01)

(52) U.S. Cl.
CPC ..... *B30B 15/287* (2013.01)

(58) Field of Classification Search
CPC ..... B30B 15/28; B30B 15/287; B30B 15/288; Y10T 74/20636; G05G 5/06; G05G 5/14; G05G 5/20; G05G 5/24; G05G 2700/08
USPC ..... 100/219; 74/527
See application file for complete search history.

(56) References Cited

U.S. PATENT DOCUMENTS 2,185,551 A * 1/1940 Glasner ..... B30B 15/287 192/144
5,560,262 A * 10/1996 Orzech ..... B60N 2/0806 248/423
5,845,751 A 12/1998 Chant
2015/0336347 A1* 11/2015 Kitaura ..... B30B 15/28 74/527

FOREIGN PATENT DOCUMENTS

JP 51-123972 A 10/1976
JP 2005-059065 A 3/2005
(Continued)

*Primary Examiner* — Jimmy T Nguyen
(74) *Attorney, Agent, or Firm* — Norris McLaughlin, P.A.

(57) ABSTRACT

A slide lock device for a press machine in which a plurality of entry holes are formed in a flange portion of a flange member fixed on a shaft member, and that locks the shaft member not to rotate by a plurality of pin members inserted into and engaged with the plurality of entry holes, including an annular main body member fixed to a main body frame, a plurality of arcuate entry holes formed in the flange portion, an annular piston member installed within an annular cylinder bore formed in the main body member and shiftable along the axial direction, an annular first and second fluid pressure working chambers for driving the annular piston member, and adapted so that the plurality of pin members can be inserted into and through the entry holes and put into inserted positions by fluid pressure, and also can be backed out of the entry holes and changed over to retracted positions.

7 Claims, 8 Drawing Sheets

(56) References Cited

FOREIGN PATENT DOCUMENTS

| | | | |
|---|---|---|---|
| JP | 2007-245172 | A | 9/2007 |
| WO | 2014/0168998 | A1 | 7/2016 |
| WO | 2014/122775 | A1 | 1/2017 |

* cited by examiner

SLIDE LOCK DEVICE FOR PRESS MACHINE

TECHNICAL FIELD

The present invention relates to a slide lock device for a press machine that is capable of stopping a slide of a press machine in a desired stopped position or in the vicinity thereof.

BACKGROUND ART

Various types of slide lock device for a press machine have been implemented in practice that can lock a slide of the machine so that, during repairs to the press machine, repairs to a die, exchange of a die, and so on, the slide does not shift downward with respect to the main body of the machine.

The slide lock device described in Patent Document #1 is a slide lock device that, by engaging a plurality of engagement claws with gear teeth of a large sized helical gear that raises and lowers the slide via an eccentric mechanism, locks the helical gear in any desired position.

And the slide lock devices for press machines described in Patent Document #2 and #3 are slide lock devices that are capable of locking a slide of a press machine by locking a crank shaft that rotates together with the raising and lowering operation of the slide, so that the crank shaft cannot rotate.

Each of these slide lock devices comprises: a flange member having a barrel portion that is fitted over the crank shaft and is fixed thereto and a flange portion that extends peripherally outward from the end portion of the barrel portion along a plane that is orthogonal to the axis of the crank shaft, a main body member that is fixed to a main body frame of the press machine and that is fitted over the barrel portion so that it is rotatable relatively thereto, an auxiliary body member that is disposed to oppose the flange portion from the side opposite to the main body member, four reception holes formed in the main body member, four pin members that are installed in the four reception holes so as to be shiftable therein, a plurality of arcuate entry holes formed in the flange portion, four support holes formed in the auxiliary body member, and four air cylinders that are capable of driving the four pin members forward and backward in the axial direction of the crank shaft.

When the slide is to be locked, the pin members are driven forward so as to pass through the entry holes and to pass into the support holes; and, when the slide is to be unlocked, the pin members are driven to retract, so that they are removed from the support holes and the entry holes.

In the case of the slide lock device described in Patent Document #3, an annular first locking member is provided between the main body member and the flange portion, a first locking mechanism is provided that is capable of locking the four pin members in their retracted positions with the first locking member, an annular second locking member is provided on the outer surface side of the auxiliary body member, and a second locking mechanism is provided that is capable of locking the four pin members in their advanced positions with the second locking member.

PRIOR ART DOCUMENT

Patent Document

Patent Document #1: Japanese Laid-Open Patent Publication 2007-245172. Patent Document #2: WO2014/016898. Patent Document #3: WO2014/122775.

SUMMARY OF INVENTION

Problem to be Solved by the Invention

In case of the slide lock device of Patent Document #1, since it is necessary to employ a construction in which three lock units are disposed in the space at the external periphery of the helical gear and are solidly fixed to the main body frame of the press machine, accordingly the size of the entire device is increased, and the manufacturing cost also becomes high.

And, in case of the slide lock devices of Patent Documents #2 and #3, since it is necessary to provide four air cylinders for respectively driving each of the four pin members, and since each of these air cylinders requires a fluid pressure working chamber and an air supply passage for forward drive and also a fluid pressure working chamber and an air supply passage for backward drive, accordingly the number of components in the slide lock device is increased, and the manufacturing cost also becomes high.

Moreover, in the case of the slide lock device of Patent Document #3, the first and second locking members and the first and second locking mechanisms increase the device size, and the manufacturing cost also becomes high.

The objective of the present invention is to provide a slide lock device for a press machine in which the number of components is low, and with which it is possible to reduce the cost of production with a simple construction.

Means to Solve the Problem

The present invention presents a slide lock device for a press machine that locks a shaft member that rotates together with raising and lowering operation of a slide that is supported by a main body frame of a press machine so that the shaft member cannot rotate, comprising a flange member having a barrel portion that is fitted over the shaft member and is fixed thereto so as not to be rotatable relative thereto and a flange portion that extending from an end portion of the barrel portion along a plane orthogonal to an axis of the shaft member up to an external periphery, an annular main body member that is fitted over the barrel portion so as to be rotatable with respect thereto and that is fixed to the main body frame, a plurality of reception holes formed in the main body member and parallel to the axis, a plurality of pin members installed in the plurality of reception holes so as to be capable of shifting forward and backward therein, and a plurality of arcuate entry holes formed in the flange portion, and that locks the shaft member via the flange member so that the shaft member cannot rotate by driving the plurality of pin members forward toward the flange portion by fluid pressure and inserting them into the plurality of entry holes, characterized by comprising: an annular piston member that is installed within an annular cylinder bore formed in the main body member so as to be shiftable through a predetermined stroke in a direction parallel to the axis, and in which the plurality of reception holes are formed; an annular first fluid pressure working chamber defined within the annular cylinder bore for driving the annular piston member forward toward the flange portion; a second fluid pressure working chamber defined within the annular cylinder bore for driving the annular piston member backward in the direction to distance from the flange portion; and a first opposing wall portion formed in the main body member so as to position in a vicinity of the flange portion from a side of the annular piston, and a plurality of first support holes formed in the first opposing wall portion so as to oppose the plurality of reception holes; wherein the plurality of pin members are respectively installed in the plurality of reception holes and the plurality of first support holes so as to shift freely along the axial direction, and are adapted to be capable of receiving fluid pressure in said first fluid pressure working chamber; and are adapted so that, when the annular piston member is driven forward by fluid pressure in the first fluid pressure working chamber, the plurality of pin members are put into inserted positions in which the plurality of pin members are inserted into the entry holes or into insertable positions, by fluid pressure in the first fluid pressure working chamber; and, when the annular piston member is driven backward by fluid pressure in the second fluid pressure working chamber, the plurality of pin members are changed over into retracted positions in which they are backed up out of the entry holes toward the annular piston member.

It is also possible to employ various further configurations as described below.

(1) An auxiliary body member may be provided having a second opposing wall portion that is in a vicinity of the flange portion at as side opposite to the first opposing wall portion, and that is fixed to the main body member; and, in the second opposing wall portion, a plurality of second support holes may be formed so as to oppose the plurality of first support holes, and into which tip end portions of the plurality of pin members are inserted when the pin members are in the inserted positions.

(2) Engagement portions may be provided at base end portions of the pin members toward the main body frame, having larger diameters than the reception holes.

(3) A locking mechanism may be provided that is capable of locking the annular piston member in a retracted position in which it is shifted backward to a maximum limit.

(4) In (3) above, a retracted position detection means may be provided that detects the fact that the annular piston member is in retracted position.

(5) In (1) above, a plurality of first inserted position detection means may be provided to the auxiliary body member, each of which detects that one of the plurality of pin members is in inserted position.

(6) In (1) above, a shift member that is shiftable along the axial direction together with the plurality of pin members passing through the second support holes, and a second inserted position detection means that is capable of detecting, via shifting of the shift member, that the plurality of pin members are in inserted positions, may be provided to the auxiliary body member.

Advantages of the Invention

According to the present invention, there are provided the annular piston member that is installed in the annular cylinder bore of the main body member, the plurality of pin members that are installed in the plurality of reception holes in the annular piston member so as to be capable of shifting forward and backward, the first fluid pressure working chamber for driving the annular piston member forward, the second fluid pressure working chamber for driving the annular piston member backward, the plurality of arcuate entry holes formed in the flange portion, and the plurality of first support holes formed in the first opposing wall portion; and it is possible to lock the slide when the annular piston member is driven forward by the fluid pressure in the first fluid pressure working chamber, thereby the shaft member is made impossible to rotate due to the plurality of pin members being shifted by the fluid pressure in the first fluid working chamber to their inserted positions in which they are inserted into the entry holes, or to their insertable positions. Furthermore, when the annular piston member is driven backward by fluid pressure in the second fluid pressure working chamber, by changing over the plurality of pin members to their retracted positions in which they are backed out from the entry holes toward the piston member, it is possible for the flange member and the shaft member to become rotatable and thus for the locking of the slide to be canceled.

Since a structure is provided in which the plurality of pin members can be changed over between their inserted positions or their insertable positions and their retracted positions by the plurality of pin members shifting together with the annular piston member, accordingly it is not necessary to provide a plurality of fluid pressure cylinders for driving the plurality of pin members forward and backward, and since it is possible to drive the plurality of pin members forward and backward by driving the annular piston member forward and backward with fluid pressures supplied to the first and second fluid pressure working chambers, accordingly the structure for driving the plurality of pin members forward and backward can be simplified, so that it is possible to reduce the manufacturing cost.

With regard to the operation and the beneficial effects obtained from the various optional structures described in (1) through (6) above, the explanation thereof will be omitted here, since they are explained in detail in the description of the embodiments.

DESCRIPTION OF EMBODIMENTS

Figure 1:
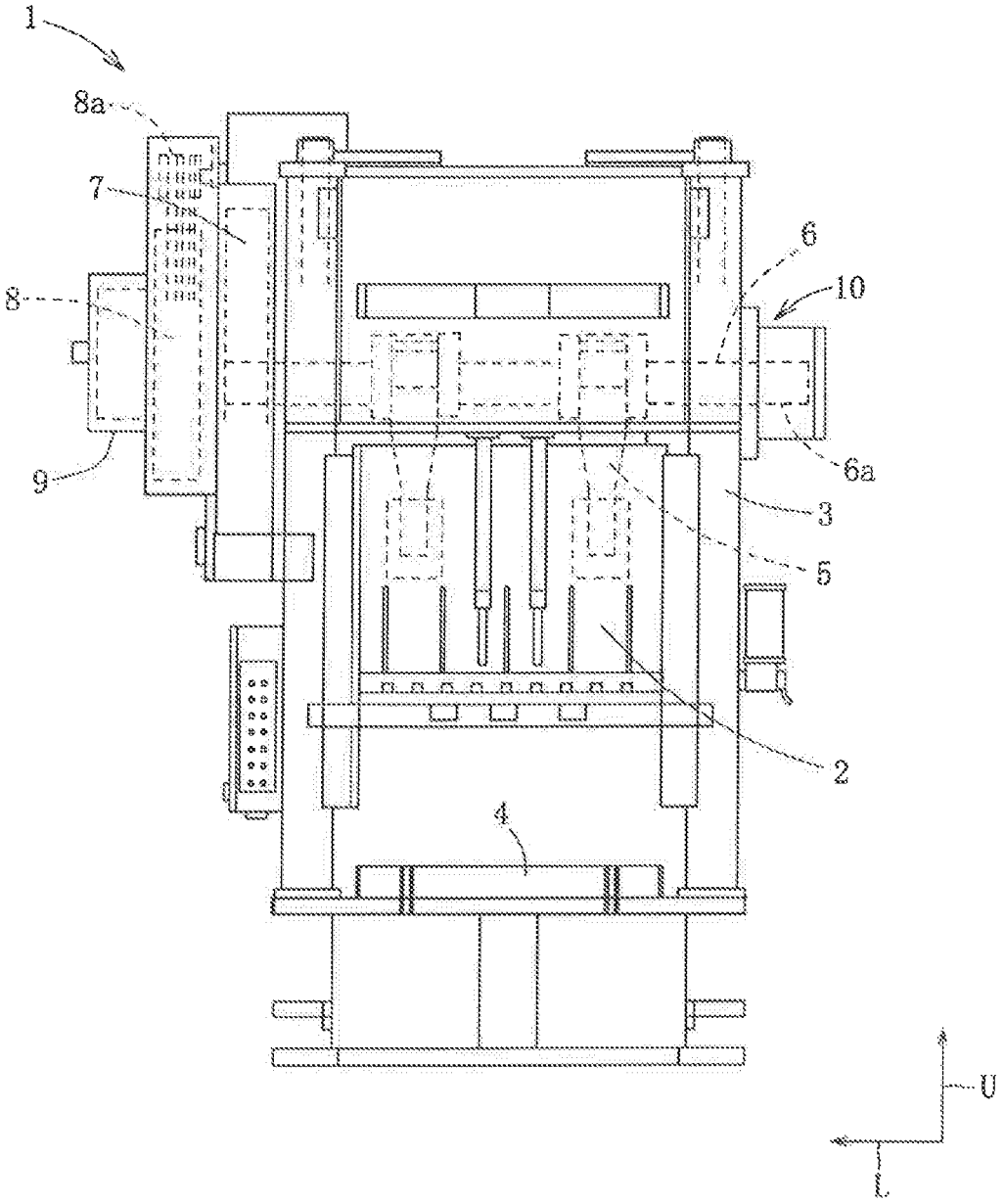
FIG. 1 is an elevation view of a press machine and a slide lock device according to a first embodiment of the present invention.
Figure 2:
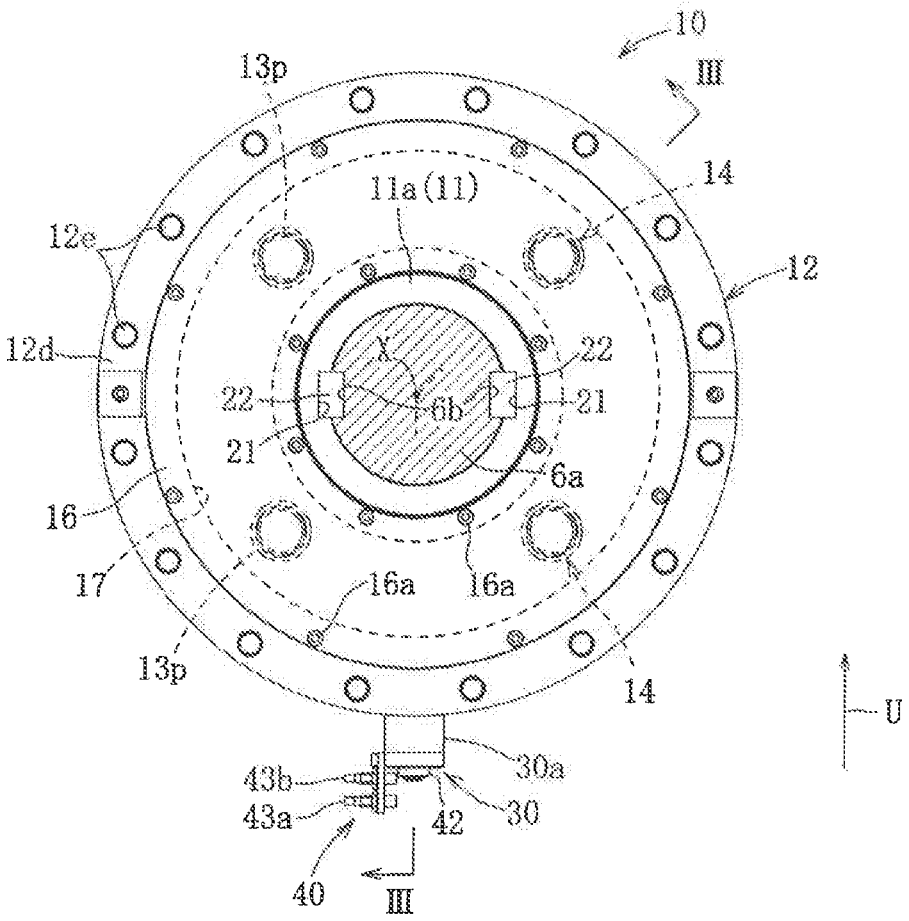
FIG. 2 is a left side view of the slide lock device.

Embodiments for implementing the present invention will now be explained on the basis of the following description.

Embodiment I

The slide lock device for a press machine is a device that locks the slide of the press machine by locking a shaft member that rotates together with the raising and lowering operation of the slide, so that the shaft member cannot rotate. In the drawings, the arrow "L" indicates the leftward direction, while the arrow "U" indicates the upward direction.

As shown in FIG. 1, the press machine 1 according to this embodiment is a typical crank press, and this press machine 1 comprises a main body frame 3, a bolster 4, a slide 2 that is supported on the main body frame 3 so as to move upwards and downwards freely, a crank shaft 6 (i.e. a shaft member) whose axis X extends in the left to right direction and that drives a pair of con-rods 5 via which the slide 2 is raised and lowered, a main gear 7 that is fixed to the left end portion of the crank shaft 6, a flywheel 8 that is linked to the main gear 7 via a gear (not shown), a clutch mechanism 9, an electrically operated motor (not shown) that rotationally drives a pulley 8*a* that is linked to the flywheel by a belt, and so on. The slide lock device 10 is attached to an shaft extension portion 6*a* at the right end of the crank shaft 6 and to the main body frame 3.

In this slide lock device 10, an annular piston member 13 may, for example, be made from an aluminum alloy, while its other members, which constitute its greater portion, may be made from steel. However, a seal member is made from synthetic resin.

In the following, the slide lock device will be explained on the basis of FIGS. 2 through 6.

The slide lock device 10 comprises a flange member 11 that rotates in synchrony with the crank shaft 6, a main body member 12, an annular piston member 13 that can shift forward and backward along the direction of an axis X, a plurality of pin members 14 (i.e. four thereof) that are made from metal and that have predetermined strengths, an auxiliary body member 15, an annular cylinder bore 17 that receives the annular piston member 13, a locking mechanism 30 that is capable of preventing forward shifting of the annular piston member 13, and so on, and is a device that drives the plurality of pin members 14 between their inserted positions and their retracted positions.

Figure 3:
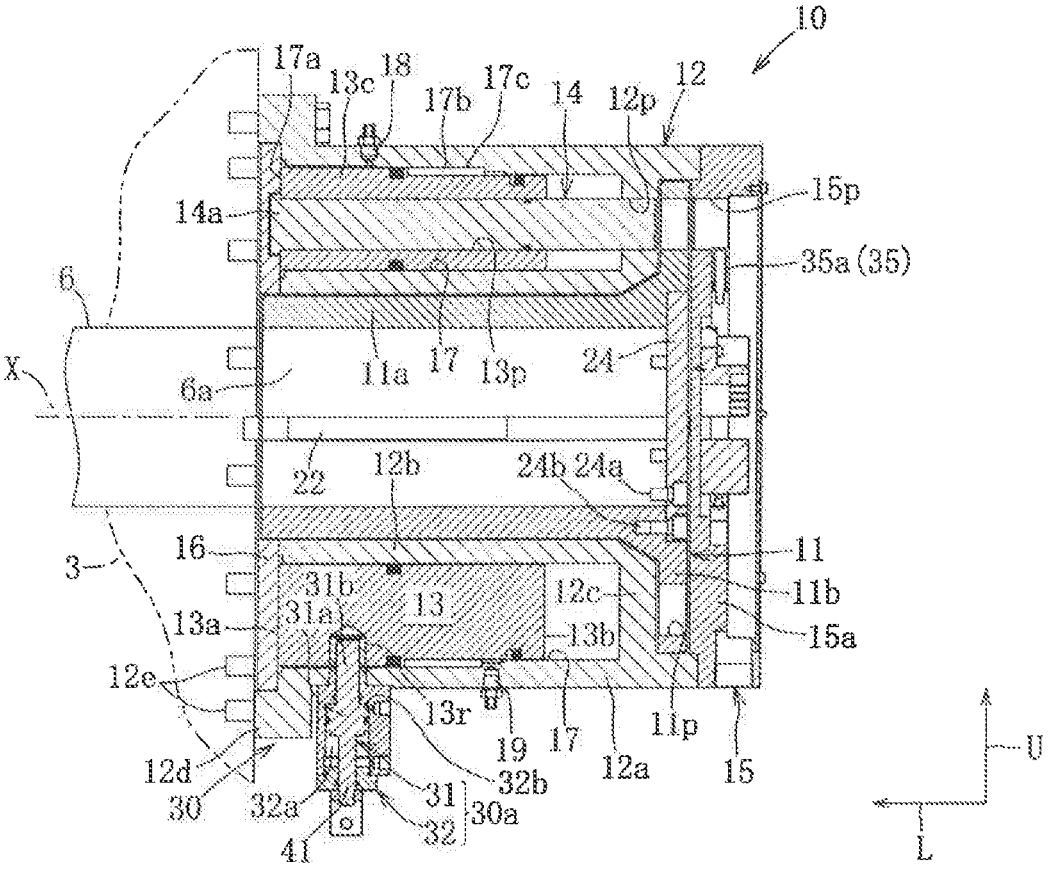
FIG. 3 is a sectional view taken along III-III line of FIG. 2.
Figure 4:
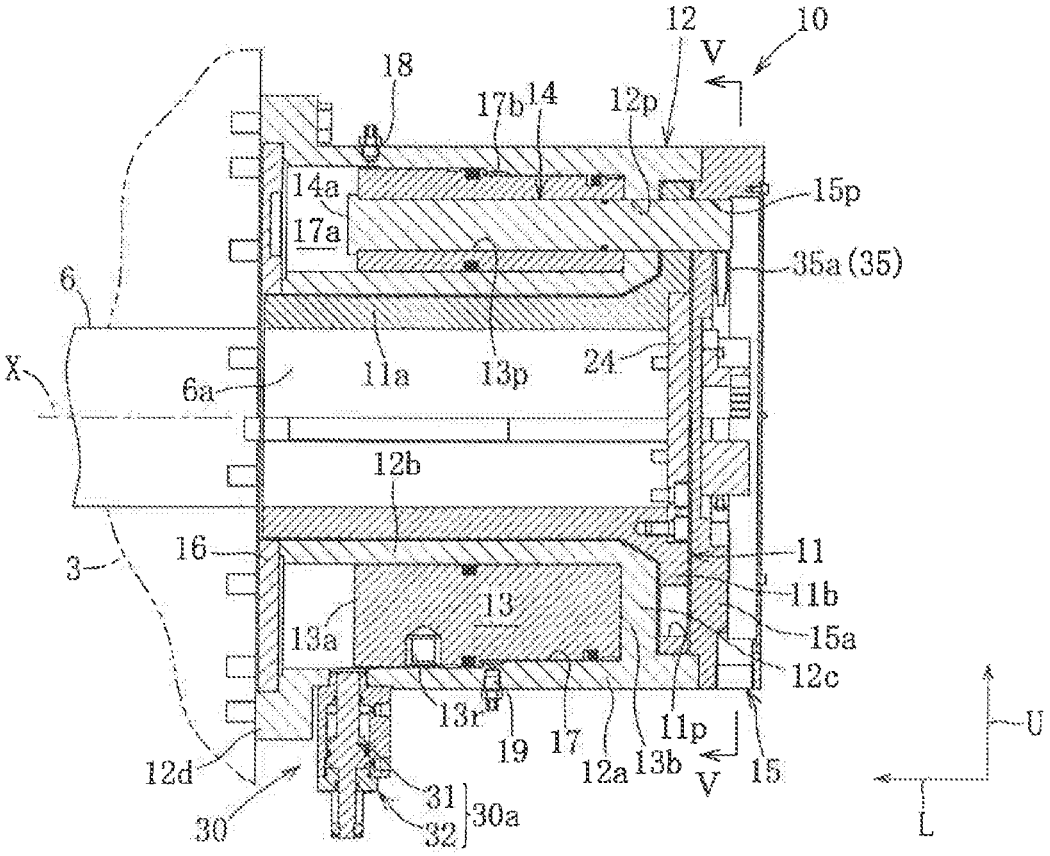
FIG. 4 is a vertical sectional view of the slide lock device.

As will be described hereinafter, the position of the pin member 14 shown in FIG. 3 is its retracted position and the position of the pin member 14 shown in FIG. 4 is its inserted position, and the position in which the end of the pin member 14 (i.e. its right end) is contacted against the left side surface of a flange portion 11*b* is its position in which it can be inserted, i.e. its insertable position.

The shaft extension portion 6*a* projects out rightward from the right side of the exterior of the main body frame 3 for a predetermined length. The flange member 11 is an annular member that is fitted over and fixed to the shaft extension portion 6*a* so that it cannot rotate relatively thereto. The flange member 11 comprises a barrel portion 11*a* that is tightly fitted over the shaft extension portion 6*a* and is fixed thereto so that it cannot rotate relatively thereto, and the annular flange portion 11*b* that is formed integrally with the right end portion of the barrel portion 11*a* and that extends outward in a plane orthogonal to the axis X of the crank shaft 6. The thickness of the flange portion 11*b* in the left to right direction in the figure is set to a predetermined thickness.

This flange member 11 is prevented from rotating with respect to the shaft extension portion 6*a* by a pair of key members 22 that are tightly fitted between a pair of key grooves 21 formed in the barrel portion 11*a* and extending in the left to right direction, and a pair of key grooves 6*b* formed in the shaft extension portion 6*a* and extending in the left to right direction. The flange member 11 is fixed by bolts 24*b* to a circular pressure plate 24 that is fixed by bolts 24*a* to the end of the shaft extension portion 6*a*, so that it cannot shift with respect thereto in the left to right direction.

Figure 5:
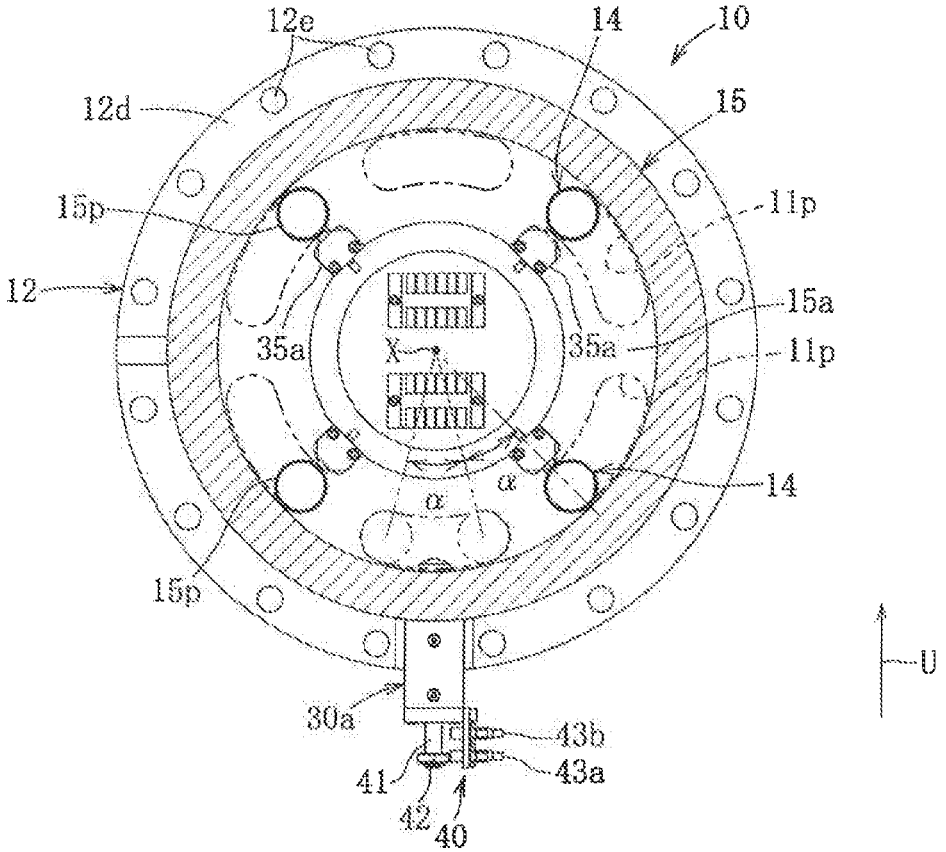
FIG. 5 is a sectional view taken along V-V line of FIG. 4.

As shown in FIG. 5, six (for example) entry holes 11*p* are formed so as to pierce through the flange portion 11*b*, and these entry holes 11*p* are formed in the shapes of circular arcs extending in the circumferential direction, at positions each of which is separated by a predetermined distance from the axis X of the crank shaft 6. The entry holes 11*p* are formed so that the right end portions of the pin members 14 can enter into them and become engaged therein, with the extents of the entry holes 11*p* in the circumferential direction being approximately three times the diameter of the pin members 14, and with the angle α being, for example, 30°.

When the four pin members 14 are changed over from their retracted positions as shown in FIG. 3 to their inserted positions as shown in FIG. 4, whatever the rotational phase of the crank shaft 6 may be, among the four pin members 14, at least a pair of the pin members 14 on opposite sides of the axis X of the crank shaft 6 will enter into a pair of the entry holes 11*p*, and thereafter, due to the crank shaft 6 being rotated through only a small angle, the remaining pair of pin members 14 will be able to enter into another pair of entry holes 11*p*. In this manner, the four pin members 14 go into their inserted positions, in which they are all inserted into four of the entry holes 11*p*.

Figure 6:
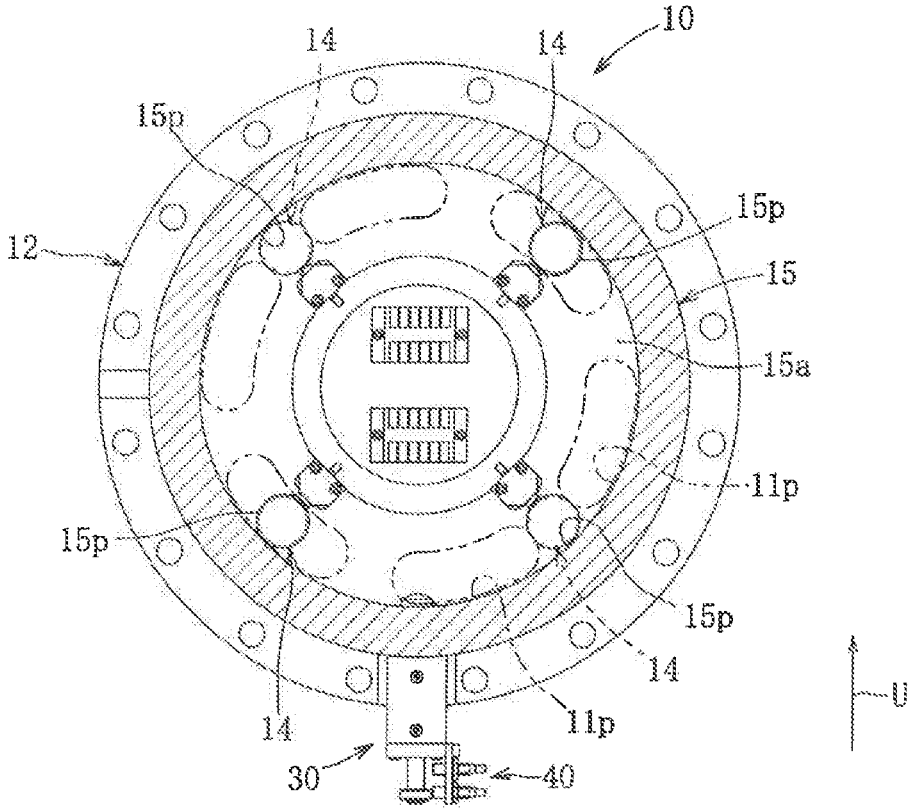
FIG. 6 is a drawing corresponding to FIG. 5, for explanation of an insertable position.

As shown in FIG. 6, the positions of the pin members 14 before the crank shaft 6 is rotated through only a small angle and the pin members 14 are inserted into the entry holes 11*p* in which they are contacted against the left side surface of the flange portion 11*b*, are positions in which they can be inserted (i.e. insertable positions).

Next, the main body member 12 will be explained.

As shown in FIGS. 2 through 5, the main body member 12 is an annular member that is fitted over the barrel portion 11*a* so as to be concentric with respect to the crank shaft 6, with a minute clearance being left between them so that they can rotate freely with respect to one another. By a fixing flange 12*d* formed on the left end portion of the main body member 12 being attached by a plurality of bolts 12*e* to the main body frame 3, the main body member 12 is fixed to the outer surface of the main body frame 3 of the press machine 1, on its right side.

The main body member 12 comprises an outer barrel portion 12*a* that extends from the fixing flange 12*d* up to the external periphery of the flange portion 11*b* with a minute clearance remaining with respect to the outer circumferential surface of the flange portion 11*b*, an inner barrel portion 12*b* that is fitted over the barrel portion 11*a* so as to be able to rotate freely with respect thereto and extending in the left to right direction, an annular first opposing wall portion 12*c* that connects the right end portion of the inner barrel portion 12*b* and the right end portion of the outer barrel portion 12*a* and that opposes the flange portion 11*b* from the side of the annular piston member 13, a blocking plate 16 that seals the left end portion of an annular cylinder bore 17 that is defined between the outer barrel portion 12*a* and the inner barrel portion 12*b*, and so on. This blocking plate 16 is fixed to the main body member 12 by a plurality of bolts 16*a*. Moreover, an auxiliary body member 15 is provided that covers the right ends of the main body member 12, the flange portion 11*b*, and the pressure plate 24, with the auxiliary body member 15 being fixed to the main body member 12 by a plurality of bolts (not shown).

The first opposing wall portion 12*c* is formed so as to be parallel to the flange portion 11*b* and to approach toward it from the left side, and opposes the flange portion 11*b* with a gap of 2 to 3 mm being left between them. Four first support holes 12*p* are formed in the first opposing wall portion 12*c* at positions that divide its circumference into four equal parts, extending parallel to the axis X of the crank shaft 6 and positioned at locations that are separated from the axis X by the same distance as the distance from the axis X to the entry holes 11*p*. The first support holes 12*p* are formed as holes having circular cross sections, and the pin members 14 are inserted therein so as to slide freely in the left to right direction.

An annular cylinder bore 17 is defined within the main body member 12, and is formed so as to be concentric with the axis X of the crank shaft 6 and to extend in the left to right direction. This annular cylinder bore 17 is demarcated by the outer barrel portion 12*a*, the inner barrel portion 12*b*, the first opposing wall portion 12*c*, and the blocking plate 16. The annular piston member 13, which is shorter than the annular cylinder bore 17, is installed within the annular cylinder bore 17 so as to be capable of sliding freely therein along the direction parallel to the axis X. A large diameter portion 13*c* is formed at the left end portion of the annular piston member 13, and a large diameter hole portion 17*c* that is longer than the large diameter portion 13*c* is formed in the annular cylinder bore 17.

An annular first working chamber 17*a* (i.e. a first fluid pressure working chamber) is defined at the left side of the annular piston member 13 within the annular cylinder bore 17, and an annular second working chamber 17*b* (i.e. a second fluid pressure working chamber) is defined more to the right in the large diameter hole portion 17*c* than the large diameter portion 13*c*.

The first and second working chambers 17*a*, 17*b* are respectively connected to first and second air ports 18, 19 that are provided in the outer barrel portion 12*a*, and these ports can supply pressurized air to the chambers and discharge air therefrom. The first air port 18 is formed to pass through the outer barrel portion 12*a* in the vicinity of its left end, and communicates with the first working chamber 17*a* via a clearance at the external circumference of the large diameter portion 13*c*. On the other hand, the second air port 19 is formed to pass through the outer barrel portion 12*a* at an intermediate portion thereof, and communicates with the right end portion of the second working chamber 17*b*. Each of the first and second air ports 18, 19 is connected to a pressurized air supply source (not shown) by an air hose or an air conduit.

The auxiliary body member 15 opposes the flange portion 11*b*, the pressure plate 24, and the outer barrel portion 12*a* from their right sides, and is fixed to the main body member 12 by a plurality of bolts (not shown). This auxiliary body member 15 has a second opposing wall portion 15*a* that opposes the flange portion 11*b* from its right side. The second opposing wall portion 15*a* is formed to be parallel to the flange portion 11*b*, and faces the flange portion 11*b* with a clearance of 2 to 3 mm between them. Four second support holes 15*p* are formed in the second opposing wall portion 15*a* at positions that are separated by the same distance from the axis X of the crank shaft 6 as the distance to the entry holes 11*p*, and these holes extend parallel to the axis X and divide the second opposing wall portion circumference into four equal parts, with each of the holes facing one of the four first support holes 12*p*. The second support holes 15*p* are formed as holes having circular cross sections, so that the pin members 14 can enter into them by sliding freely.

Next, the annular piston member 13 will be explained.

The annular piston member 13 is made from a metal (for example, aluminum alloy) that is lighter in weight than the pin member 14, and is installed within the annular cylinder bore 17 so as to be shiftable in the left and right direction (i.e., the direction parallel to the axis X). As shown in FIGS. 3 and 4, this annular piston member 13 has a left end surface 13*a* and a right end surface 13*b* that extend orthogonally to the axis X of the crank shaft 6, and is formed to be shorter than the length of the annular cylinder bore 17.

Four reception holes 13*p* are formed in the annular piston member 13 at positions that divide its circumference into four equal parts, parallel to the axis X and at positions that are separated therefrom by the same distance as the distance from the axis X of the crank shaft 6 to the entry holes 11*p*, so as respectively to oppose the four first support holes 12*p* and the four second support holes 15*p*. The reception holes 13*p* are formed as holes having circular cross sections in which the pin members 14 are installed so as to be capable of sliding freely, and the four pin members 14 are installed therein so as each to be shiftable in the left and right direction (i.e., in a direction parallel to the axis X).

A stopper portion 14*a* (i.e. a flanged portion) is formed at the left end portion of each of the pin members 14, and these portions 14*a* have diameters larger than the diameter of the reception hole 13*p* and moreover are received within the first working chamber 17*a*.

When pressurized air is supplied to the first working chamber 17*a* and also pressurized air is discharged from the second working chamber 17*b*, the annular piston member 13 is shifted in the rightward direction and comes to be in its advanced position in which it is contacted against the first opposing wall portion 12*c*, and each of the pin members 14 goes either into an inserted position in which its portion at its end (i.e. its right end portion) is inserted into its corresponding first support hole 12*p*, one of the entry holes 11*p*, and its corresponding second support hole 15*p*, or into an insertable position in which its end contacts against the flange portion 11*b*.

On the other hand, when pressurized air is supplied to the second working chamber 17*b* and also pressurized air is discharged from the first working chamber 17*a*, the annular piston member 13 is shifted in the leftward direction and comes to be in its retracted position in which it is retracted to the maximum extent, and each of the pin members 14 comes to be in a retracted position. When each of the pin members 14 is in this retracted position, its stopper portion 14*a* contacts against the blocking plate 16, and its end (i.e. its right end) comes to be in its retracted position in which it has been withdrawn from the entry hole 11*p* and is backed up toward the annular piston member 13.

When the annular piston member 13 is shifted to its advanced position, since the stopper portions 14*a* of the pin members 14 receive the pressure of the pressurized air in the first working chamber 17*a*, accordingly they are shifted integrally rightward together with the annular piston member 13 in the state in which the stopper portions 14*a* are contacted against the left end surface 13*a* of the annular piston member 13, so that the pin members 14 go into their inserted positions or into their insertable positions. And, when the annular piston member 13 is shifted to its retracted position, since the stopper portions 14*a* are pushed leftward by its left end surface 13*a*, accordingly the stopper portions 14*a* of the pin members 14 are contacted against the blocking plate 16, and, until the annular piston member 13 comes into contact against the blocking plate 16 and is stopped, the pin members 14 are driven in the leftward direction and are brought into their retracted positions. And, when the pin members 14 are in their retracted positions, the tip end portions of the pin members 14 remain in the state in which they are inserted into the first support holes 12*p*. For this reason, the annular piston member 13 is always in the state in which it cannot rotate around the axis X at any time.

Next, the locking mechanism 30 will be explained.

The locking mechanism 30 is a device that, during operation of the press machine 1, locks the annular piston member 13 in its retracted position in which it is retracted to the maximum limit, and that thus locks the four pin members 14 in their retracted positions. A recessed portion 13*r* for locking is formed in the vicinity of the left end of the annular piston member 13, on an external lower circumferential portion thereof. The locking mechanism 30 incorporates a compact double acting type air cylinder 30*a* having a piston member 31 that, when the annular piston member 13 is in its retracted position, can be engaged into the recessed portion 13*r* for locking.

This air cylinder 30*a* comprises a piston member 31, a case member 32, a forward drive air chamber 32*a*, and a reverse drive air chamber 32*b*, and the piston member comprises a piston portion 31*a* and a piston rod 31*b*. The forward drive air chamber 32*a* and the reverse drive air chamber 32*b* are connected to a source of pressurized air by external air hoses or air conduits (not shown). When the annular piston member 13 is in its retracted position, then, when pressurized air is supplied to the forward drive air chamber 32*a*, the piston member 31 is shifted toward the annular piston member 13 and goes into its locked position shown in FIG. 3, in which the tip end portion of the piston rod 31*b* is engaged with the recessed portion for locking 13*r*.

On the other hand, when pressurized air is supplied to the reverse drive air chamber 32*b*, the piston member 31 is returned to its original position in which it is not engaged with the recessed portion for locking 13*r*. And, when the annular piston member 31 is in its advanced position, since a portion of the piston rod 31*b* of the piston member 31 which is in its original position (i.e. its returned state) confronts the outer circumferential surface of the annular piston member 13, accordingly the piston member 31 is in a state in which it cannot shift toward the annular piston member 13 (i.e. the locking mechanism 30 cannot operate). This is order, when the annular piston member 13 is in its advanced position, to prevent the piston rod 31*b* being advanced into the first working chamber 17*a* and making it impossible for the annular piston member 13 to be retracted, thus providing fail-safe operation.

Next, a retracted position detection means 40 that detects the fact that the annular position member 13 is in its retracted position will be explained. A detection rod 41 is formed integrally with the piston member 31 of the air cylinder 30*a* and projects from the case member 32 for a predetermined length so as to extend from the piston member 31 in the direction away from the piston rod 31*b*, and a detection nub 42 is attached to the end of the detection rod 41, with a first detection switch 43*a* being provided that is approached by the detection nub 42 when the piston member 31 is in its original position, and a second detection switch 43*b* being provided that is approached by the detection nub 42 when the piston member 31 is in its locked position. These first and second detection switches 43*a* and 43*b* are connected to a control unit (not shown) that controls this slide lock device 10.

Next, four first inserted position detection means 35 that detect the facts that each of the four pin members 14 is in its inserted position will be explained. Four proximity switches 35*a* are fitted to the second opposing wall portion 15*a* of the auxiliary body member 15, and, in the state in which the four pin members 14 are in their inserted positions, these proximity switches are respectively close to the outer circumferential surfaces of the right end portions of those pin members 14; and these four proximity switches 35*a* are electronically connected to the control unit described above. Since the proximity switches 35*a* corresponding to the four pin members 14 go to ON in the state in which those pin members are in their inserted positions, accordingly it is possible to detect that the four pin members 14 are in their inserted positions.

Next, the operation and the beneficial effects of the slide lock device 10 will be explained.

According to this slide lock device 10, the annular cylinder bore 17 is formed in the main body member 12, the annular piston member 13 is installed in the annular cylinder bore 17 so as to be shiftable in a direction parallel to the axis X, the annular piston member 13 can be driven to its advanced position by pressurized air in the first working chamber 17*a*, and the annular piston member 13 can be changed over to its retracted position by pressurized air in the second working chamber 17*b*.

The four pin members 14 are installed in the four reception holes 13*p* that are formed in the annular piston member 13 so that they can shift forward and backward freely therein, and, when the four pin members 14 are in the state of being inserted into the four first support holes 12*p* that are formed in the first opposing wall portion 12*c* of the main body member 12 and the annular piston member 13 is shifted to its advanced position, the four pin members 14 can be changed over to their inserted positions in which they are inserted into the four entry holes 11*p* of the flange portion 11*b* and into the four second support holes 15*p* of the second opposing wall portion 15*a*, and it is thus possible to lock the shaft extension portion 6*a* and the flange member 11 so that they cannot rotate.

Moreover, when the annular piston member 13 is in its retracted position, the four pin members 14 are changed over to their retracted positions, and are in the state of being backed out from the four entry holes 11*p* and from the four second support holes 15*p*, so that it is possible for the locking of the shaft extension portion 6*a* and the flange member 11 to be canceled.

Since the four pin members 14 are not individually driven by respective air cylinders, but rather a structure is provided in which the four pin members 14 are driven by pressurized air in the first and second working chambers 17*a*, 17*b* to be shifted all together via the annular piston member 13, accordingly the structure for shifting the four pin members 14 over the entire range between their inserted positions and their retracted positions is remarkably simplified, so that it is possible to reduce the number of components and to reduce the cost of production.

Since, when the four pin members 14 are in their inserted positions, the end portions of the pin members 14 are in the state of being inserted into the first support holes 12*p*, the entry holes 11*p*, and the second support holes 15*p*, so that a state is established in which both their ends are supported at both sides of the flange portion 11*b*, accordingly this is advantageous from the standpoint of strength and durability of the pin members 14.

Moreover since the stopper portions 14*a*, which have larger diameters than the reception holes 13*p*, are provided at the left end portions of the pin members 14 and are positioned within the first working chamber 17*a*, accordingly it is possible to drive the four pin members 14 in their insertion directions in synchrony with the forward shifting of the annular piston member 13 by the pressurized air in the first working chamber 17*a*, and it is also possible to drive the four pin members 14 in their retraction directions in synchrony with the backward shifting of the annular piston member 13. It is also possible to engage the pin members 14 to the annular piston member 13 by the stopper portions 14*a*.

Furthermore, since the locking mechanism 30 is provided that is capable of locking the annular piston member 13 in its retracted position in which it is shifted backward to the maximum extent, and thereby the annular piston member 13 is kept in its retracted position during operation of the press machine 1, accordingly it is possible reliably to keep the four pin members 14 in their retracted positions, so that the system may be considered to be fail-safe. Moreover, since with this structure it is not possible for the locking mechanism 30 to operate when the annular piston member 13 is in its advanced position, accordingly the system may be considered to be fail-safe from this point of view as well.

And, since the retracted position detection means 40 is provided that detects the fact that the annular piston member 13 is in its retracted position, accordingly it is possible to detect the fact that the four pin members 14 are in their retracted positions with this single retracted position detection means which has a simple structure.

Yet further, since the four first inserted position detection means 35 are provided to the second opposing wall portion 15*a* that respectively detect that the four pin members 14 are in their inserted positions, accordingly it is possible reliably to detect that the slide 2 has been put into the locked state.

Embodiment II

Figure 7:
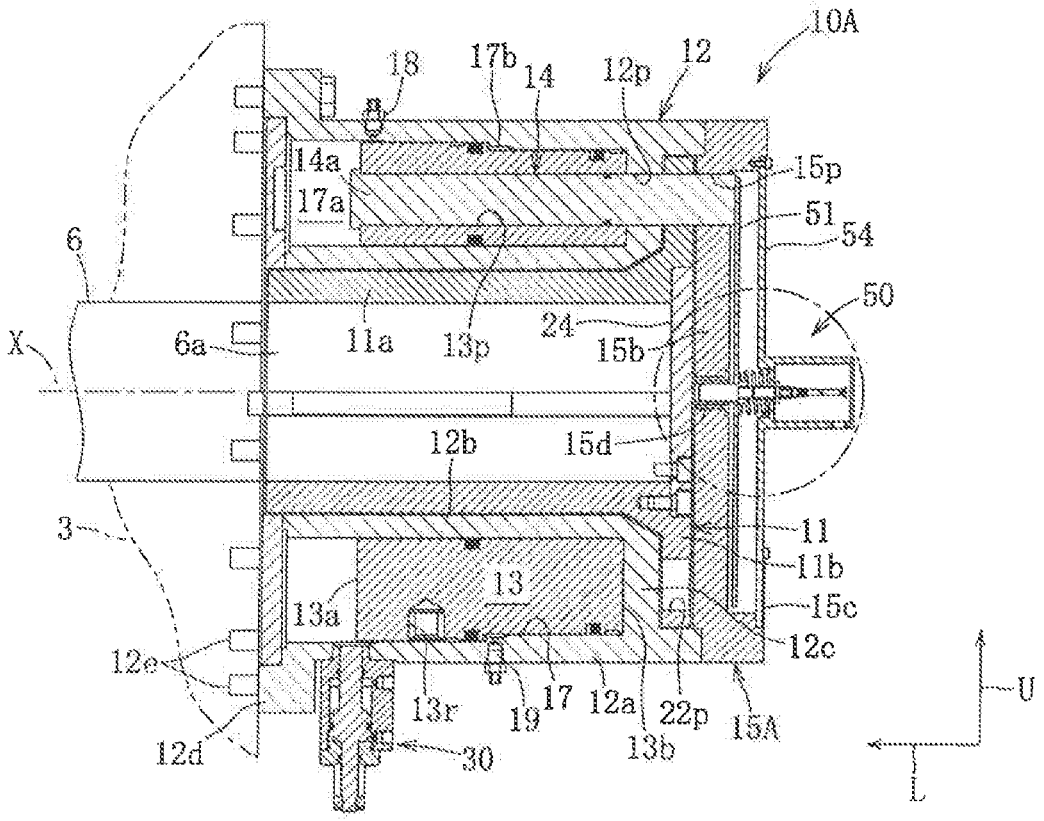
FIG. 7 is a drawing corresponding to FIG. 4 relating to a second embodiment.
Figure 8:
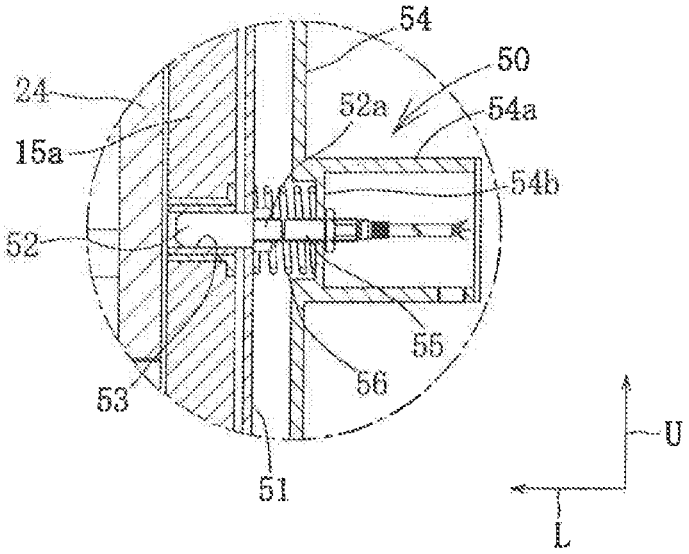
FIG. 8 is an enlarged view of essential portions of FIG. 7.

Next, a slide lock device 10A according to a second embodiment will be explained on the basis of FIGS. 7 and 8. In this slide lock device 10A, instead of the plurality of first inserted position detection means 35 described above, a single second inserted position detection means 50 is provided. Only the structures of this second embodiment that are different from the first embodiment will be explained, since the other structures are not changed.

A circular plate 51 (i.e. a shifting member) is disposed in the vicinity of the second opposing wall portion 15*a* of the auxiliary body member 15 and of the right ends of the four pin members 14, and a guidance shaft 52 that is fixed to the center portion of the circular plate 51 is inserted into a guidance hole 52 that is formed in the second opposing wall portion 15*a* so as to shift freely therein. A detection portion 52*a* is formed at the end of the guidance shaft 52.

At the rear end of the auxiliary body member 15, a circular cover plate 54 is fixed with a plurality of screws to the outer side of the circular plate 51 (i.e. to its right side). A spring reception plate 54*b* is formed integrally with a boss portion 54*a* at the center portion of the cover plate 54, and, within this boss portion 54*a*, a proximity switch 55 is installed to the spring reception plate 54*b*. A compression spring 56 is installed around the external peripheries of the detection portion 52*a* and the proximity switch 55, and the circular plate 51 is biased leftward by a compression spring 56 and is held in the state of contacting against the ends of the four pin members 14.

When the four pin members 14 are not in their inserted positions, the circular plate 51 is in the state of contacting against the second opposing wall portion 15*a*, and the proximity switch 55 goes to OFF, since the gap between the detection portion 52*a* and the proximity switch 55 is opened up. But, when the four pin members 14 go to their inserted positions, since the circular plate 51 is pushed rightward by the pin members 14, accordingly the gap between the detection portion 52*a* and the proximity switch 55 is reduced, and the proximity switch 55 goes to ON. The proximity switch 55 described above is electrically connected to the control unit described above.

Since, with the second inserted position detection means 50 described above, it is possible to detect the fact that the four pin members 14 are in their inserted position with a single detection means, accordingly it is possible to reduce the cost of production with a simple structure in which the number of components is low.

Next, variant embodiments in which the above embodiments are partially altered will be explained.

1) The number of the reception holes 13*p*, the first and second support holes 12*p*, 15*p*, and the pin members 14 is not to be considered as being limited to four; there could be three or fewer thereof, or five or more thereof. And the number of the entry holes 11*p* is not to be considered as being limited to 6; there could be five or fewer thereof, or seven or more thereof. Moreover, it would also be possible to set the sizes of the entry holes 11*p* in the circumferential direction in an appropriate manner according to the number of the entry holes 11*p*.

2) While, in the embodiments described above, examples were explained in which pressurized air was employed as the pressurized fluid that was supplied to the first and second working chambers 17*a*, 17*b*, a similar function could be obtained if pressurized oil is employed.

3) While, in the embodiments described above, examples were explained in which the stopper portions 14*a* of the pin members 14 projected leftward from the left end surface of the annular piston member 13, it would also be acceptable to form concave portions on the left end surface of the piston member 13, and thus to arrange for the left end surfaces of the stopper portions 14*a* and the left end surface of the annular piston member 13 to be coplanar.

4) It would also be possible to arrange to provide a structure in which a fixing flange portion is formed on the auxiliary body member 15, this auxiliary body member 15 is contacted against the main body frame 3*a*, and the fixing flange portion is fixed to the main body frame 3*a* by a plurality of bolts, and for the shaft extension portion 6*a* to pass through the auxiliary body member 15 and to extend outward, with the pressure plate 24 being omitted, so that the side of the blocking plate 16 becomes the free end side. With this construction, the main body member 12 comes to be fixed to the main body frame 3*a* via the auxiliary body member 15.

It should be understood that, for a person skilled in the art, it would be possible to implement the slide lock device of the present invention by partially altering the first or the second embodiment, provided that no departure is made from the scope of the gist of the present invention, and the present invention is to be considered as including this type of partially altered example.

POSSIBILITY OF INDUSTRIAL APPLICATION

The present invention provides a slide lock device that, according to requirements, is capable of reliably locking a slide of a press machine.

REFERENCE SIGNS LIST

1: press machine
2: slide
3: main body frame
6: crank shaft
6*a*: shaft extension portion
10: slide lock device
11: flange member
11*a*: barrel portion

11*b*: flange portion
11*p*: entry hole
12: main body member
12*c*: first opposing wall portion
12*p*: first support hole
13: annular piston member
13*p*: reception hole
14: pin member
14*a*: engagement portion
15: auxiliary body member
15*a*: second opposing wall portion
15*p*: second support hole
17: annular cylinder bore
17*a*: first working chamber
17*b*: second working chamber
30: locking mechanism
40: retracted position detection means
35: first inserted position detection means
50: second inserted position detection means
51: circular plate (shifting member)

The invention claimed is:

1. A slide lock device for a press machine that locks a shaft member that rotates together with raising and lowering operation of a slide that is supported by a main body frame of the press machine so that the shaft member cannot rotate, comprising a flange member having a barrel portion that is fitted over the shaft member and is fixed thereto so as not to be rotatable relative thereto and a flange portion extending from an end portion of the barrel portion along a plane orthogonal to an axis of the shaft member up to an external periphery, an annular main body member that is fitted over the barrel portion so as to be rotatable with respect thereto and that is fixed to the main body frame, a plurality of reception holes formed in the main body member and parallel to the axis of the shaft member, a plurality of pin members installed in the plurality of reception holes so as to be capable of shifting forward and backward therein, and a plurality of arcuate entry holes formed in the flange portion, and that locks the shaft member via the flange member so that the shaft member cannot rotate by driving the plurality of pin members forward toward the flange portion by fluid pressure and inserting the plurality of pin members into the plurality of entry holes, the slide lock device further comprising:

an annular piston member that is installed within an annular cylinder bore formed in the main body member so as to surround the shaft member and be shiftable through a predetermined stroke in a direction parallel to the axis of the shaft member, and in which the plurality of reception holes are formed;

an annular first fluid pressure working chamber defined within the annular cylinder bore for driving the annular piston member forward toward the flange portion;

an annular second fluid pressure working chamber defined within the annular cylinder bore for driving the annular piston member backward in a direction to move apart from the flange portion; and a first opposing wall portion formed in the main body member so as to position in a vicinity of the flange portion from a side of the annular piston member, and a plurality of first support holes formed in the first opposing wall portion so as to oppose the plurality of reception holes;

wherein the plurality of pin members are respectively installed in the plurality of reception holes and the plurality of first support holes so as to shift freely along an axial direction of the shaft member, and are configured to receive fluid pressure in said first fluid pressure working chamber;

and are configured so that, when the annular piston member is driven forward by fluid pressure in the first fluid pressure working chamber, the plurality of pin members are put into inserted positions in which the plurality of pin members are inserted into the entry holes or into insertable positions, by fluid pressure in the first fluid pressure working chamber; and, when the annular piston member is driven backward by fluid pressure in the second fluid pressure working chamber, the plurality of pin members are changed over into retracted positions in which they are backed up out of the entry holes toward the annular piston member.

2. The slide lock device for a press machine according to claim 1, wherein:

an auxiliary body member is provided having a second opposing wall portion that is in a vicinity of the flange portion at a side opposite to the first opposing wall portion, and that is fixed to the main body member; and in the second opposing wall portion, a plurality of second support holes are formed so as to oppose the plurality of first support holes, and into which tip end portions of the plurality of pin members are inserted when the pin members are in the inserted positions.

3. The slide lock device for a press machine according to claim 1, wherein engagement portions are provided at base end portions of the pin members toward the main body frame, having larger diameters than the reception holes.

4. The slide lock device for a press machine according to claim 1, wherein a locking mechanism is provided that is capable of locking the annular piston member in a retracted position in which the annular piston member is shifted backward to a maximum limit.

5. The slide lock device for a press machine according to claim 4, further comprising a retracted position detection means configured to detect that the annular piston member is in retracted position.

6. The slide lock device for a press machine according to claim 2, further comprising a plurality of first inserted position detection means provided to the auxiliary body member, each of which is configured to detect that one of the plurality of pin members is in inserted position.

7. The slide lock device for a press machine according to claim 2, further comprising a shift member that is shiftable along the axial direction together with the plurality of pin members passing through the second support holes, and a second inserted position detection means configured to detect, via shifting of the shift member, that the plurality of pin members are in inserted positions, are provided to the auxiliary body member.

* * * * *